US010773178B2

(12) United States Patent
Demas

(10) Patent No.: US 10,773,178 B2
(45) Date of Patent: Sep. 15, 2020

(54) COLLAPSIBLE ACTIVITY FRAME

(71) Applicant: Venus Nix Demas, New York, NY (US)

(72) Inventor: Venus Nix Demas, New York, NY (US)

( * ) Notice: Subject to any disclaimer, the term of this patent is extended or adjusted under 35 U.S.C. 154(b) by 0 days.

(21) Appl. No.: 16/527,035

(22) Filed: Jul. 31, 2019

(65) Prior Publication Data

US 2020/0038771 A1 Feb. 6, 2020

Related U.S. Application Data

(60) Provisional application No. 62/713,166, filed on Aug. 1, 2018.

(51) Int. Cl.

| | |
|---|---|
| ***A63G 21/02*** | (2006.01) |
| ***A63H 33/00*** | (2006.01) |
| ***A63G 31/00*** | (2006.01) |
| *A63H 3/52* | (2006.01) |

(52) U.S. Cl.
CPC ..... *A63H 33/008* (2013.01); *A63G 21/02* (2013.01); *A63G 31/00* (2013.01)

(58) Field of Classification Search
CPC ..... A63G 21/00; A63G 21/02; A63G 21/04; A63G 21/18; A63H 3/00; A63H 3/52; A63H 33/008
USPC ..... 472/116, 117, 128; 446/476–478, 446/487–488
See application file for complete search history.

(56) References Cited

U.S. PATENT DOCUMENTS

| | | | | |
|---|---|---|---|---|
| 220,429 | A * | 10/1879 | Russell | |
| D303,826 | S * | 10/1989 | Aker | D21/818 |
| 5,437,573 | A * | 8/1995 | Rodriguezferre | A63G 21/00 472/116 |
| 5,580,573 | A * | 12/1996 | Kydonieus | A61K 9/2027 424/448 |
| 6,383,084 | B1 * | 5/2002 | McEachen | A63B 9/00 472/116 |
| 6,772,780 | B2 | 8/2004 | Price | |
| 7,025,236 | B1 | 4/2006 | Naujock | |
| 7,533,681 | B2 | 5/2009 | Miller | |
| 8,413,827 | B2 | 4/2013 | Taylor | |
| 2008/0128413 | A1 | 6/2008 | Garcia | |

* cited by examiner

*Primary Examiner* — Kien T Nguyen
(74) *Attorney, Agent, or Firm* — Kanika Radhakrishnan; Evergreen Valley Law Group

(57) ABSTRACT

The present disclosure provides a collapsible activity structure. The structure includes panels arranged in a chain-like structure through hinges. Each hinge is coupled to a first connecting end of a panel to a second connecting end of an adjacent panel of the plurality of panels. In a folded position of hinges, the panels are in a stacked configuration. A coupling member including a male coupling member and a female coupling member is provided. The male coupling member is disposed onto the first connecting end of a first end panel and the female coupling member is disposed onto the second connecting end of a second end panel of the chain-like structure. The male and the female coupling members are coupled to each other to lock the first and the second end panels in an unfolding position of the hinges to form a frustum configuration.

18 Claims, 7 Drawing Sheets

COLLAPSIBLE ACTIVITY FRAME

TECHNICAL FIELD

The present disclosure generally relates to an activity frame and, more specifically to, a collapsible and portable activity frame for children.

BACKGROUND

Children are generally curious and open to learning. As such, they are eager to learn regarding the aspects surrounding them. In the recent past, parents are taking an initiative to subject their children to various experiences, for making them more resourceful in the later part of their life. One such initiative is the use of a children playground which includes a variety of toys and other entertaining activities for the child.

Typically, every toy in the children playground is highly utilitarian for play purposes. The playground may also include toys such as, but are not limited to, sliders, climbers and the like, which are bulky and occupy substantial space. These toys are typically stationary and fixed on the floor, and thus unmovable. This configuration of the conventional climber toys renders unmodularity, which translates to the fact that the parents are unable to set up these climbers at the desired destination.

To overcome the limitations in the conventional playground toys, portable activity frames are designed. The portable activity frames can be placed at the desired destination by suitable manipulation. However, the conventional portable activity frames are not as substantial or usable as the toys stationed in the playground. Accordingly, there is a need for techniques which can overcome one or more limitations stated above in addition to providing other technical advantages.

SUMMARY

Various embodiments of the present disclosure provide a collapsible activity structure. The collapsible activity structure includes a plurality of panels arranged in a chain-like structure through a plurality of hinges. Each panel of the plurality of panels includes a first connecting end and a second connecting end. Each hinge of the plurality of hinges couples with the first connecting end of a panel to the second connecting end of an adjacent panel of the plurality of panels, wherein in a folded position of the plurality of hinges, the plurality of panels is in a stacked configuration. A coupling member including a male coupling member and a female coupling member is provided. The male coupling member is disposed onto the first connecting end of a first end panel and the female coupling member is disposed onto the second connecting end of a second end panel of the chain-like structure. The male coupling member and the female coupling member are coupled to each other to lock the first end panel and the second end panel in an unfolding position of the plurality of hinges to form a frustum configuration.

In another embodiment of the present disclosure, the collapsible activity structure is disclosed. The structure includes the plurality of panels arranged in the chain-like structure through the plurality of hinges. Each panel of the plurality of panels includes the first connecting end and the second connecting end. Each hinge of the plurality of hinges couples with the first connecting end of the panel to the second connecting end of the adjacent panel of the plurality of panels, wherein in the folded position of the plurality of hinges, the plurality of panels is in the stacked configuration. The coupling member including the male coupling member and the female coupling member is provided. The male coupling member is disposed onto the first connecting end of a first end panel of the chain-like structure and the female coupling member is configured onto the second connecting end of the second end panel of the chain-like structure. The male coupling member and the female coupling member are coupled to each other to lock the first end panel and the second end panel in the unfolding position of the plurality of hinges to form the frustum configuration. A seat member is configured on a top surface of each panel of the plurality of panels in the unfolded position of the plurality of hinges, the seat member configured to enable seating of a child. A slide member having one end coupled to a coupling unit configured proximal to a top surface of a panel and another end resting on a ground surface is provided. The coupling unit is configured on a top surface of the panel, wherein the slide member is inclined relative to a ground surface for enabling the child to slide therefrom.

In yet another embodiment, the collapsible activity structure includes four panels arranged in a chain-like structure through a plurality of hinges. Each panel includes the first connecting end and the second connecting end. Each hinge of the plurality of hinges coupling the first connecting end of the panel to the second connecting end of the adjacent panel of the four panels, wherein in a folded position of the plurality of hinges, four panels are in a stacked configuration. The coupling member includes the male coupling member and the female coupling member. The male coupling member is disposed onto the first connecting end of the first panel of the chain-like structure and the female coupling member is configured onto the second connecting end of a fourth panel of the chain-like structure. The male coupling member and the female coupling member are coupled to each other to lock the first panel and the fourth panel in an unfolding position of the plurality of hinges to form the frustum configuration.

BRIEF DESCRIPTION OF THE FIGURES

The following detailed description of illustrative embodiments is better understood when read in conjunction with the appended drawings. For the purpose of illustrating the present disclosure, exemplary constructions of the disclosure are shown in the drawings. However, the present disclosure is not limited to a specific device or a tool and instrumentalities disclosed herein. Moreover, those in the art will understand that the drawings are not to scale. Wherever possible, like elements have been indicated by identical numbers.

Figure 1A:
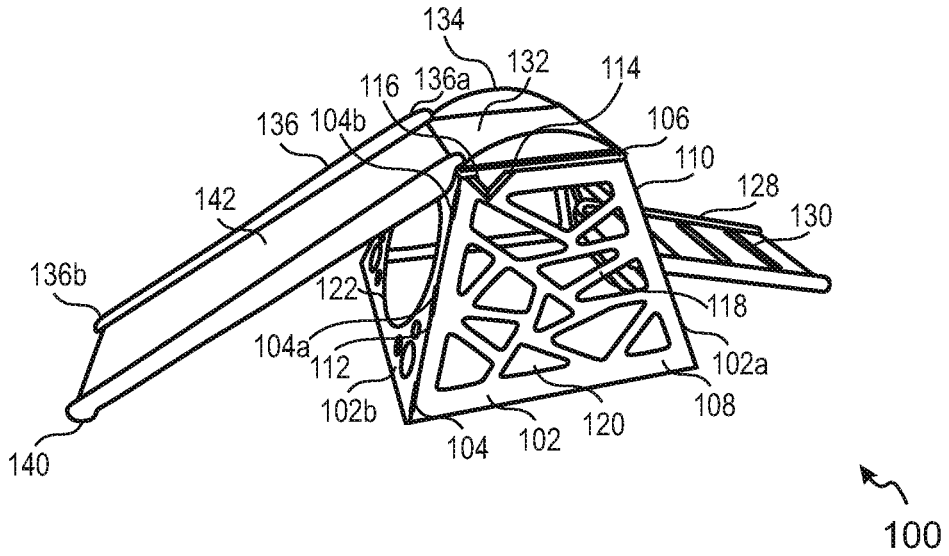
FIG. 1A is a perspective view of a collapsible activity structure, in accordance with an example embodiment of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearance of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Overview

Various embodiments of the present disclosure disclose a collapsible activity structure. The activity structure includes a plurality of panels arranged in a chain-like structure through a plurality of hinges. Each panel of the plurality of panels includes a first connecting end and a second connecting end. Each hinge of the plurality of hinges is configured to couple the first connecting end and the second connecting end of an adjacent panel to form the chain-like structure. The hinges are configured to be operable between a folded position and an unfolded position. In the folded position of the hinges, the panels are in a stacked configuration due to a closed condition of the panels. In the unfolded position of the hinges, the panels are in a frustum configuration due to an open condition or structure of the hinges. The panels may be configured with an identical configuration, for ensuring uniform structure during the connection therebetween. Further, a coupling member is provided in the activity structure. The coupling member includes a male coupling member disposed onto the first connecting end of a first end panel and a female coupling member disposed onto the second connecting end of a second end panel of the chain-like structure. The male coupling member and the female coupling member are coupled to each other to lock the first end panel and the second end panel in an unfolding position of the hinges, to form the frustum configuration.

The activity structure further includes a seat member mounted on a top surface of each panel, when the panels are in the frustum configuration. The seat member is configured to provide a seat or support a user such as a child, during the use of the activity structure. Further, at least one panel may be configured with one of irregularities or ribs for enabling the child to climb the structure. Also, at least one panel may be configured with a slot, enabling the child to enter and exit a hollow structure defined with the panels in the frustum configuration.

Further, the activity structure further includes a coupling member configured proximal to the top surface of a panel. The coupling member is configured to couple to a slide member, such that, one end of the slide member is mounted onto the coupling member while another end of the slide member is rested on a ground surface. This configuration creates an inclination to the slide member and thus, enable the child to slide along from the seat surface. Additionally, a ladder member may also be mounted onto a panel containing ridges for enabling the child to climb onto the seat member.

The activity structure further includes a plurality of support beams, each of the support beams being configured to enclose the hinges in the unfolded position. This configuration acts as a safety feature for the activity structure by enclosing pointy edges or sharp ends of the panels.

The structure is configured to be portable and modular in design, for permitting installation at a desired destination or location. The structure is also configured to accommodate a small space in the desired destination, thereby enabling installation even in households.

Various embodiments of a collapsible activity structure are explained in a detailed manner, herein with reference to FIGS. 1A-1B to FIGS. 3A to 3I.

Figure 1B:
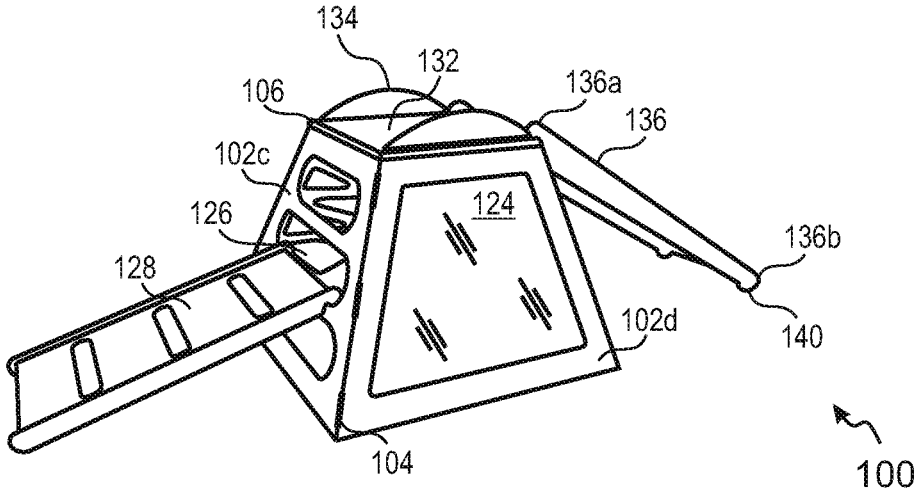
FIG. 1B is another perspective view of the collapsible activity structure, in accordance with an example embodiment of the present disclosure.

FIGS. 1A and 1B illustrate perspective views of a collapsible activity structure 100, in accordance with some example embodiment of the present disclosure. The structure 100 includes a plurality of panels 102 that are arranged in a chain-like structure via a plurality of hinges 104 (collectively referred for hinge 104*a*, 104*b*, etc.). Each panel comprises a top surface 106, a bottom surface 108, a first connecting end 110 and a second connecting end 112. Each panel also includes a front surface 114 and a rear surface 116 (illustrated by cutting a portion of the panel 102*a*). Each of the first connecting end 110, the second connecting end 112, the front surface 114 and the rear surface 116 may be configured with identical dimensions, for ease of connection therebetween to form the chain-like structure.

The panels 102 are connected to each other via the plurality of hinges 104 (interchangeably referred to hereinafter as hinges 104), such that, each hinge (for e.g., hinge 104*a* or 104*b*) couples with the first connecting end 110 of a panel (for e.g., panel 102*a*) and the second connecting end 112 of an adjacent panel (for e.g., panel 102*b*), thereby forming the chain-like structure.

Each hinge (for e.g., 104*a* or 104*b*) may include a first plate structure (not shown in Figures) and a second plate structure (not shown in Figures) pivotally connected to one another to form the hinge. As such, the first plate structure may be connected to the first connecting end 110, while the second plate structure may be connected to the second connecting end 112. The hinge 104 (i.e., the first and the second plate structures) may be connected to the first connecting end 110 and the second connecting end 112 via conventional connecting means selected from one of fastening, welding, brazing, etc., or any other suitable techniques as per feasibility and requirement. The hinge 104 is configured to be operable between a folding position and an unfolding position. In the folding position, the first and the second plate structures may be positioned towards each other. In the unfolding position, the first and the second plate structures may be positioned away from each other. As such, the positions of the plurality of panels 102 (interchangeably referred to hereinafter as panels 102) corresponds to position of the hinges 104, i.e. the first and the second plate structures.

In one implementation, the hinges 104 may be operated inwardly to the folded position, wherein in the folded position (for e.g. as shown in FIG. 1A) of the hinges 104, the panel 102*a* and the panel 102*b* are positioned towards each other to form a closed structure (for e.g. shown in FIG. 3A), thereby forming a stacked configuration. In other words, the front surfaces (or rear surfaces) of the panel 102*a* and the panel 102*b* are positioned towards each other, in the folding position of the hinges 104. Therefore, in the folded position, the panels 102 accommodate a smaller area or footprint, thereby ensuring portability.

Figure 3A:
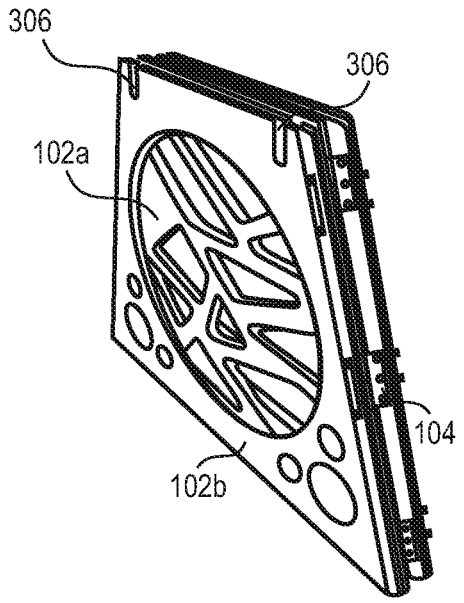
FIG. 3A is a schematic view of a plurality of panels in a closed condition, when a plurality of hinges of the collapsible activity frame is in a folded position, in accordance with an example embodiment of the present disclosure.
Figure 3B:
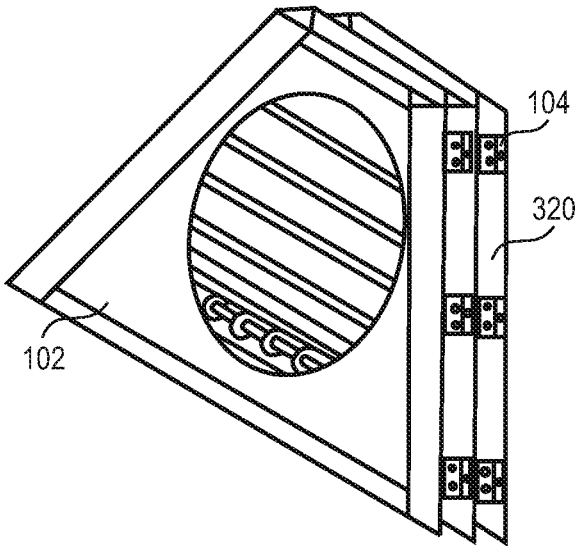
FIG. 3B is a schematic view of the plurality of panels in the closed condition and the configuration of the hinges connecting the plurality of panels, in accordance with an example embodiment of the present disclosure.
Figure 3C:
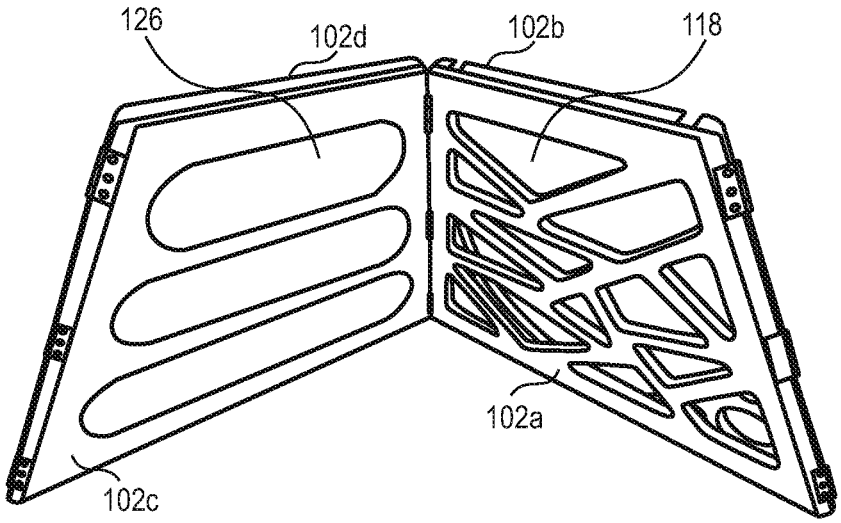
FIG. 3C is a schematic view of the plurality of panels being unfolded, in accordance with an example embodiment of the present disclosure.
Figure 3D:
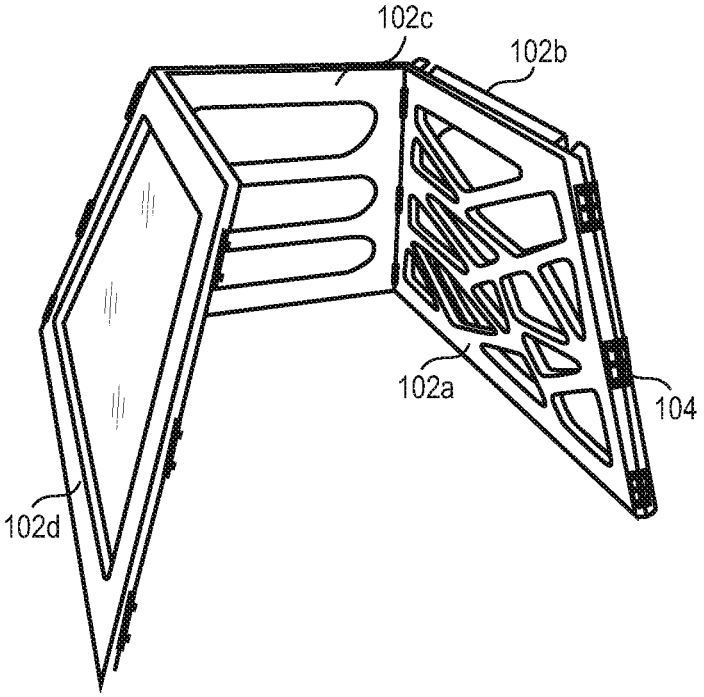
FIG. 3D is a schematic view of the plurality of panels being unfolded, in accordance with another example embodiment of the present disclosure.
Figure 3E:
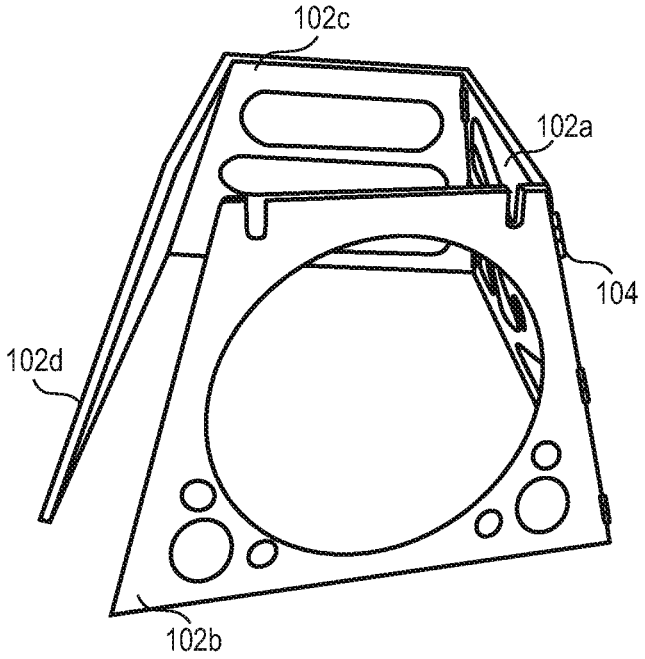
FIG. 3E is a schematic view of the plurality of panels in an open condition or open structure, in accordance with an example embodiment of the present disclosure.

In another implementation, the hinges 104 may be operated outwardly to the unfolded position, wherein in the unfolded position, the panel 102*a* and the panel 102*b* are positioned away from each other to form an open structure (for e.g. shown in FIG. 3E). In other words, the front surfaces (or rear surfaces) of the panels 102*a* and 102*b* are positioned away from each other, in the unfolding position of the hinges 104. Therefore, in the unfolded position, the panels 102 form an open structure, which enables to mount or assemble the structure 100. The unfolding of the panels 102 for mounting the structure 100 at a desired destination or location is described with reference to FIGS. 3A to 3I.

In one configuration, each panel (i.e., the panel 102*a* or the panel 102*b*) of the plurality of panels 102 may be configured with identical dimensions, so that a stable and a flush configuration of the structure 100 is obtained upon assembly or arrangement. In one implementation, each panel may be trapezoidal in configuration, such that the width of the panel (for e.g., the panel 102*a* or the panel 102*b*) at the top surface 106 of the panel is smaller than the width of the panel at the bottom surface 108. This configuration ensures that a larger surface area contacts a ground surface, thereby ensuring stability to the structure 100 during use. Also, the trapezoidal configuration of the panels 102 requires the hinges 104 to be inclined based on the angular inclination of the connecting ends 110 and 112 of the panels 102 to form a flush construction. The angular inclination also configures the structure 100 to a pyramid-like structure or a frustum configuration. This configuration includes the panels 102 inclined as per the angular inclination of the connecting ends 110 and 112, which translates to improved stability of the structure 100 during use by the child. In one configuration, the frustum configuration is a configuration which includes a larger base portion than a top portion of the structure 100. The frustum configuration, due to its inclination, ensures that the child is facilitated with sufficient grip, thereby ensuring safety. In another configuration, at least three panels may be employed to form the pyramid-like structure. As such, the number of panels used to form the pyramid-like structure may correspond to the desired configuration of the structure 100. In yet another configuration, four panels are employed to form the pyramid-like structure. Further, the angular inclination of the connecting ends 110 and 112 may be in the range of 30 degrees to about 60 degrees, based on the frustum configuration required. In one implementation, the angular inclination of the connecting ends 110 and 112 is 45 degrees.

In one embodiment, each panel may be configured to be a rectangular structure, or a curved structure or any other structure as per design feasibility and requirement. In one implementation the panels are configured to be the curved structure (not shown in Figures), which when unfolded forms a frustoconical structure.

In one configuration, the material of each panel of the panels 102 is considered based on the ease of portability and installation. As such, materials with greater strength to weight ratio may be considered, which are easier to transport and installation. In one implementation, each panel of the panels 102 may be made of materials such as, but is not limiting to plastic material, metallic material, composite material or any other material as per design feasibility and requirement.

In one configuration, the shape of each panel may be considered based on the configuration or arrangement of the hinges 104 during its operation between a folded position and an unfolded position. The hinges 104 may be selected from one of a butt hinge, a barrel hinge, a butterfly hinge, a spring hinge or any other hinge as per design feasibility and requirement. As such, based on the type of hinges 104, the panels 102 may be connected suitably to form the structure 100.

Further, at least one panel (for e.g., the panel 102*a*) of the panels 102 is configured with a plurality of ribs 118. The ribs 118 may be configured randomly on the surface of the panel. The ribs 118 are configured to allow the child to climb the structure 100 upon installation. The ribs 118 may be configured randomly or haphazardly with unique shapes and sizes over the panel. In one configuration, the ribs 118 may be formed due to multiple slots or cut-outs 120 formed on the panel. The cut-outs 120 may be of varying shapes and sizes as per design feasibility and requirement. The cut-outs 120 may be configured in the panel without affecting its strength characteristics. The ribs 118 along with the cut-outs 120 provides a visual appeal, particularly to children during use.

Figure 3F:
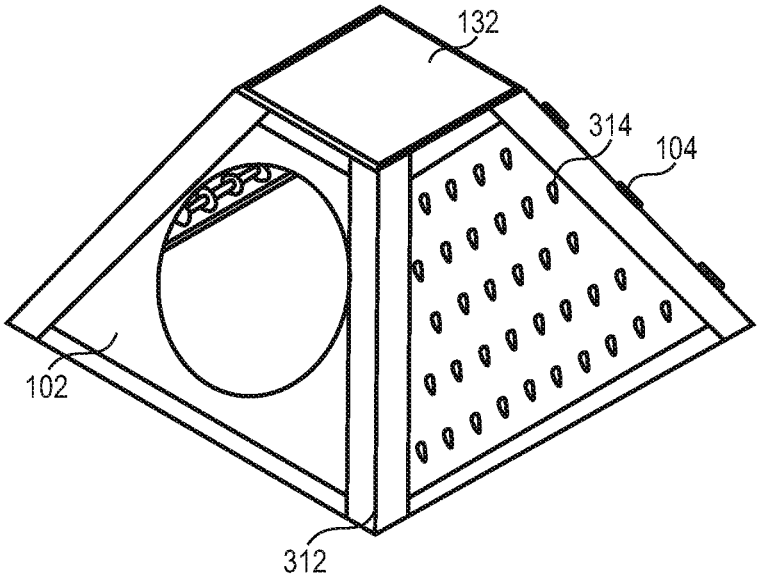
FIG. 3F is a schematic view of support beams mounted on the hinges of the collapsible activity structure, in accordance with an example embodiment of the present disclosure.

Further, at least one panel (for e.g., the panel 102*a*) of the panels 102 is configured with a plurality of protrusions 314 (for e.g. as shown in FIG. 3F). The protrusions 314 may be configured randomly on the surface of the panel. The protrusions 314 are configured to allow the child to climb the structure 100 upon installation. The protrusions 314 may be configured randomly or haphazardly with unique shapes and sizes over the panel. The protrusions 314 provides a visual appeal, particularly to children during use.

Also, at least one panel (for e.g., panel 102*b*) of the panels 102 is configured with a slot 122. The slot 122 is dimensioned to allow the child to enter and exit a hollow portion configured in the frustum configuration. The dimensions of the slot 122 may also be considered to prevent head butting or any other accidents during entry and exit therefrom. The slot 122 configuration of the panel 102*b*, provides another variant to the structure 100 usable by the child while playing or performing an activity.

Referring to FIG. 1B, at least one panel (for e.g., a panel 102*c*) of the panels 102 is configured with a writing board 124. The writing board 124 may be fastened to the panel 102*c* via conventional fastening means. As such, the writing board 124 may be replaced in the panel 102*c*, when required. The writing board maybe a blackboard (as shown in FIG. 1B) which may enable the child to scribble or write on the blackboard using a chalk piece (not shown in Figures). In one implementation, the writing board maybe a sketch board (not shown in Figures) which may enable the child to scribble or write on the sketch board using a sketch pen or a marker pen (not shown in Figures).

Further, at least one panel (for e.g., the panel 102*c* as shown in FIG. 1B) of the panels 102 is configured with elongated slots 126. The elongated slots 126 are configured to act as a means for climbing the structure 100 by the child. In one configuration, the dimensions and position of the elongated slots 126 may be selected as per feasibility and requirement. Additionally, the elongated slots 126 may also be configured to receive a ladder member 128, for ease of climbing the structure 100. The ladder member 128 has one end 128*a* hooked onto a periphery of the elongated slots 126 (for e.g., as shown in FIG. 1B), while another end 128*b* of the ladder member 128 is rested on the ground surface. The end 128*a* may be rested at an inclination from the ground surface for inclining the ladder member 128. The ladder member 128 may also include notches 130 defined perpendicularly along its length. The notches 130 are configured to enable grip to the child while climbing the ladder member 128. The notches 130 may also be dimensioned and configured as per design feasibility and requirement. In one configuration, the elongated slots 126 may be inclined about an angle, along the length of the panel 102*c*. In another configuration, the end 128*b* may be configured with footpegs (not shown in Figures) for resting the ladder member 128 on the ground surface. This configuration provides additional support and grip to the ladder member 128 during use, while also acting as a cushion to the ground surface against the loads exerted by the user during climbing. In an embodiment, the elongated slots 126 may include a groove or a projection for engaging with a pin (not shown in the Figures) configured to the end 128*a* of the ladder member 128.

Figure 3G:
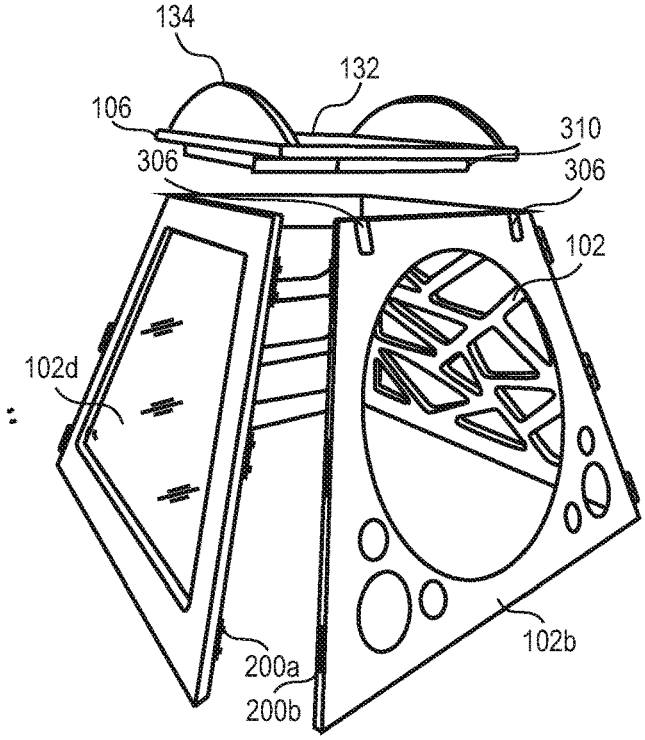
FIG. 3G is a schematic view of a seat member mounted on a top surface of each panel of the plurality of panels in the open condition of the collapsible activity structure, in accordance with an example embodiment of the present disclosure.

Referring back to FIG. 1B, the structure 100 further includes a seat member 132 configured to be mounted on the top surface 106 of the panels 102. The seat member 132 is configured to enable the child to sit, upon climbing the panels 102. The seat member 132 may be mounted to the top surface 106 of the panels 102 by conventional fastening means selected from one of fastening, snap-fitting and the like, as per design feasibility and requirement. In one configuration, the seat member 132 may include an extruded portion 310 (for e.g. as shown in FIG. 3G) extending downwardly and dimensioned corresponding to the dimensions of the periphery defined by the top surface 106 of the panels 102 in the frustum configuration. This configuration of the extruded portion 310 enables snap-fit mounting of the seat member 132 upon configuring the panels 102 to the frustum configuration. In one implementation, the dimensional tolerances of the seat member 132 may be considered such that, an interference fit may be established upon mounting on the top surface 106 of the panels 102. In another configuration, the seat member 132 may be configured with plurality of fastening members (not shown in Figures) which enables the user (for e.g., an adult, such as a parent or a caretaker) to fasten the seat member 132 onto the top surface 106 of the panels 102. Further, the seat member 132 also includes protruded edges 134 extending on its side surfaces. The edges 134 extend about a predetermined length sufficient enough to act as a holding member for the child while climbing and seating on the seat member 132. The edges 134 may be configured to a rectangular configuration, a curved or arcuate configuration (for e.g., as shown in FIGS. 1A and 1B) or any other configuration as per design feasibility and requirement. In another implementation, the seat member 132 may be configured with thickness sufficient to withstand the loads exerted by the user during use. The thickness of the seat member 132 may be considered without hindering the portability of the structure 100.

Figure 3H:
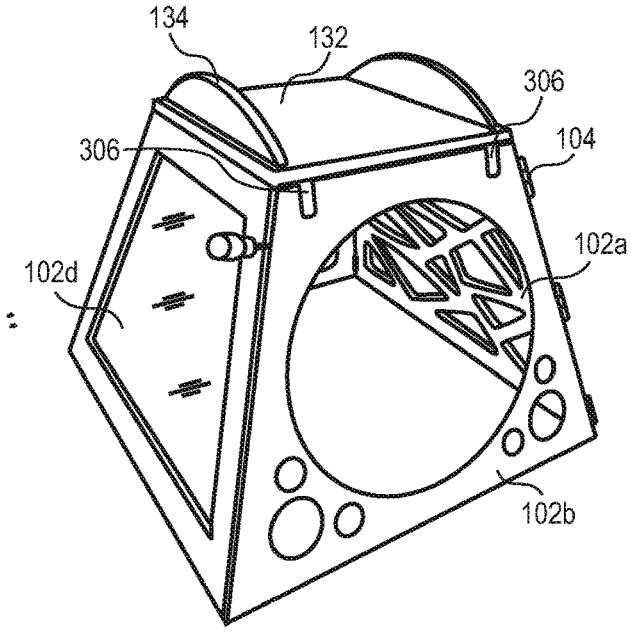
FIG. 3H is a schematic view of a first end panel coupled with a second end panel of the plurality of panels to form a frustum configuration, in accordance with an example embodiment of the present disclosure.

Further, the structure 100 includes a slide member 136 configured to allow the child to slide from the seat member 132 to the ground surface. The slide member 136 is configured to engage or couple with a coupling unit 306 (for e.g. as shown in FIG. 3H) defined on at least one panel (for e.g., a panel 102*d* as shown in FIG. 1B). The slide member 136, similar to the ladder member 128, includes one end 136*a* coupled to the coupling unit 138 and another end 136*b* rested on the ground surface. The coupling unit 306 is particularly defined proximal to the top surface 106 of the panels 102, so that the child may slide from the seat member 136. As such, the end 136*a* is connected proximal to the top surface 106, while the end 136*b* is rested on the ground surface, defining an inclination to the slide member 136. The inclination enables the child to slide from the seat member 132 to the ground surface. Further, for enabling the sliding, the surface of the slide member 136 may be polished or maybe smooth, to ensure a smooth sliding while avoiding pricking or any such incidents to the child during use. In one implementation, the slide member 136 may be rested on the ground surface via foot pegs 140 configured to the end 136*b*. This configuration provides additional support and grip to the slide member 136 during use, while also acting as a cushion to the ground surface against the loads exerted by the user during sliding. The slide member 136 also includes protruded edges 142 defined at its side surfaces. The protruded edges 142 acts as a support member while also confining the child to slide along the length of the slide member 136. The protruded edges 142 thus, acts as a safety feature to the child during use. In another implementation, the slide member 136 may be configured with a thickness sufficient to withstand the loads exerted by the user during use. The thickness of the slide member 136 may be considered without hindering the portability of the structure 100.

The structure 100 further includes a coupling member 200 disposed within the panels 102 suitably, to form the frustum configuration. The coupling member 200 includes a male coupling member 200*a* which may be disposed in a first end panel (for e.g., the panel 102*b*) and a female coupling member 200*b* which may be disposed in a second end panel (for e.g., the panel 102*d*) of the chain-like structure. The male coupling member 200*a* and the female coupling member 200*b* are coupled to each other, when the panels 102 are in the open structure to form the frustum configuration. In one configuration, the male coupling member 200*a* may be disposed at a central portion of the connecting end 110 (or the connecting end 112) of the panel 102*b*. In another configuration, the female coupling member 200*b* may be disposed at the central portion of the connecting end 112 of the panel 102*d*. In another configuration, the position of the female coupling member 200*b* corresponds to the position of the male coupling member 200*a*. In one implementation, the coupling member 200 is selected from one of a magnetic connector, a snap-fit connector or any other suitable coupling member capable of connecting the first end panel and the second end panel. In another implementation, the location of the coupling member 200 is selected to provide the structural rigidity to the connection between the first end panel and the second end panel.

Figure 2:
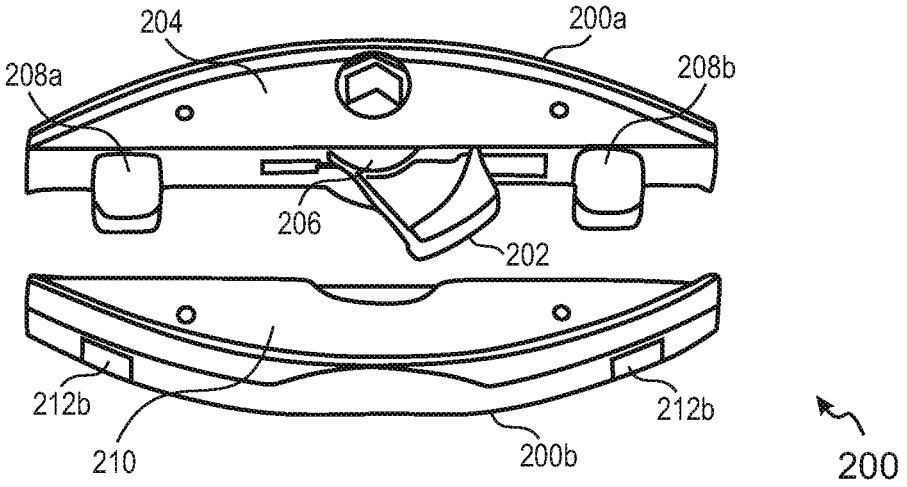
FIG. 2 is a schematic view of a coupling member of the collapsible activity structure, in accordance with an example embodiment of the present disclosure.

In an embodiment, the coupling member 200 may be a mechanical connector. The coupling member 200 includes the male coupling member 200*a* mountable onto the first end panel. The male coupling member 200*a* includes a pin 202 (for e.g., as shown in FIG. 2) extending from a housing 204. A shaft 206 is mounted connected to the pin 202 and extends from the housing 204. The user may suitably operate the shaft 206, i.e., by using suitable tools, for operating the pin 202. Protrusions 208*a* and 208*b* extend from the housing 204, which may be used for aligning the male coupling member 200*a* with the female coupling member 200*b*. Further, the coupling member 200 includes the female coupling member 200*b* mountable onto the second end panel. The female coupling member 200*b* includes a casing 210 within which, a slot 212 is configured for receiving the pin 202. The slot 212 may have a flange (not shown in Figures) which is configured to lock the pin 202 in place, upon insertion and operation of the pin 202 within the slot 212. The casing 210 also includes openings 212*a* and 212*b* corresponding to the position of the protrusions 208*a* and 208*b*. The openings 212*a* and 212*b* are configured to receive the protrusions 208*a* and 208*b* for aligning the male coupling member 200*a* and the female coupling member 200*b*.

In an embodiment, the non-exhaustive features described herein for each of the panels 102 may be interchangeably configured as per design feasibility and requirement. While several features in the panels 102 are described, the same may not be considered as a limitation. As such, additional variations or possibilities in the features are possible to be configured in the panels 102 as per feasibility and requirement.

FIGS. 3A to 3I illustrate stepwise installation of the structure 100, in accordance with some example embodiments of the present disclosure.

Initially for ease of portability, the hinges 104 are in the folded position and thus the panels 102 are in the closed structure or the stacked configuration (as shown in FIG. 3A). As already described with reference to FIGS. 1A-1B and FIG. 2, the front surface 114 (or the rear surface 116) of the panels 102 face each other during the folded position of the hinges 104, to form the stacked configuration. In one configuration, the stacked configuration of the panels 102 conform to the shape of the panel considered i.e., if the shape of the panel is trapezoidal, then the shape of the stacked configuration conforms to the trapezoidal shape.

On transporting the staked structure 100 to a desired location, the user (for e.g., an adult, such as a parent) unfolds the panels 102 suitably, based on the configuration of the stack. The user may unfold the panels 102 from a central portion of the stack (as shown in FIG. 3C). In one configuration, the panels 102 may be separated from the hinges 104 during the transportation (for e.g., as shown in FIG. 3B) and reassembled while assembling the structure 100. In this configuration, the hinges 104 may include guide members 320 which are configured to receive and lock the panels 102 therein. A locking mechanism (not shown in Figures) may be provided within the guide members 320 for locking the panels 102.

Due to such unfolding, the structure 100 may now include a stack of panels 102*a*, 102*b* spaced apart from the stack of panels 102*c*, 102*d*. The user now further unfolds the panel 102*d* (or panel 102*b*), to further unfold the structure 100 (for e.g., as shown in FIG. 3D). Further, the user may now unfold the panel 102*b* (or panel 102*b*) to unfold the structure 100 (for e.g., as shown in FIG. 3E) to the open condition 300. In the open condition 300, the panels 102*b* and 102*d* may be adjacent to each other.

In this scenario, the user may either mount the seat member 132 on the top surface 106 of the panels 102 or may couple the panels 102*b* and 102*d* via the coupling member 200. The user may mount the seat member 132 prior to coupling of the panels 102*b* and 102*d*, to ensure alignment of the structure 100 during the assembly onto the ground surface. The seat member 132 may be mounted via methods, such as conventional fastening means selected from one of fastening, snap-fitting and the like that are described in the description of FIGS. 1A and 1B (for e.g., as shown in FIG. 3G).

Figure 3I:
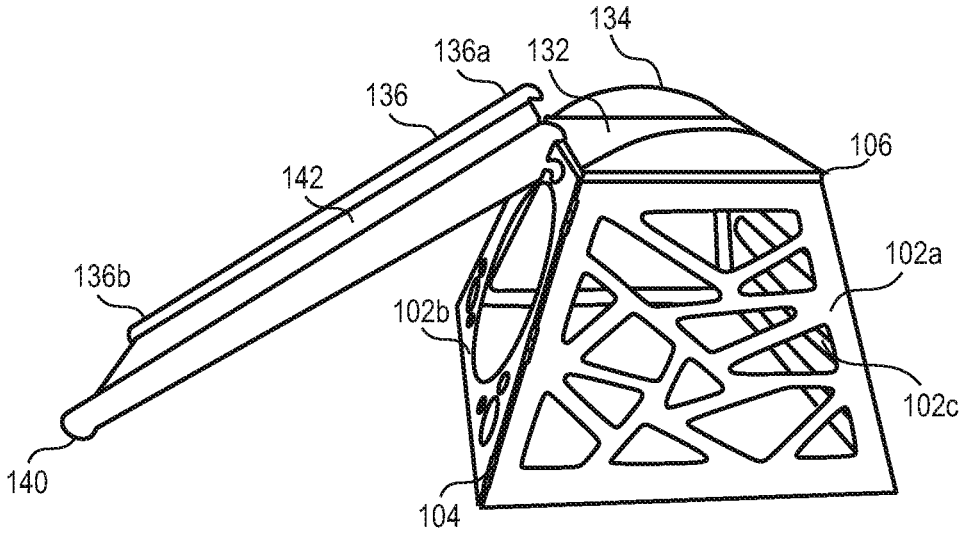
FIG. 3I is a schematic view of a slide member mounted into a panel of the plurality of panels, in accordance with an example embodiment of the present disclosure.

Upon mounting the seat member 132, the panels 102*b* and 102*d* are brought closed for engaging the male connecting member 200*a* and the female connecting member 200*b*. The male connecting member 200*a* and the female connecting member 200*b* are coupled to each other, to connect the panels 102*b* and 102*d*. The mechanism of connection between the panels 102*b* and 102*d* is already described in paragraph 44 of the description (for e.g. as is shown in FIG. 3H). Thereafter, the user mounts the slide member 136 onto the structure 100. The user mounts the slide member 136, by aligning the end 136*a* with the coupling unit 138 (for e.g., as shown in FIG. 3I) as already described in paragraph 42 of the description, to form the structure 100. Additionally, the ladder member 128 may also be mounted on the elongated slots 126 suitably (for e.g., as shown in FIGS. 1A and 1B). In an embodiment, a support beam 312 (for e.g. as shown in FIG. 3F) may be mounted to the corners of the panels 102 upon connecting the members 200*a* and 200*b*. the support beam 312 may be mounted onto the panels 102 by conventional mounting means. This configuration ensures the safety of the user during use.

The benefits and advantages described above may relate to one embodiment or may relate to several embodiments. The embodiments are not limited to those that solve any or all of the stated problems or those that have any or all of the stated benefits and advantages.

The above description is given by way of example only and various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

What is claimed is:

1. A collapsible activity structure, comprising:

a plurality of panels arranged in a chain-like structure through a plurality of hinges, each panel of the plurality of panels comprising a first connecting end and a second connecting end, each hinge of the plurality of hinges coupling the first connecting end of a panel to the second connecting end of an adjacent panel of the plurality of panels, wherein in a folded position of the plurality of hinges, the plurality of panels are in a stacked configuration;

a coupling member comprising a male coupling member and a female coupling member, the male coupling member disposed onto the first connecting end of a first end panel and the female coupling member disposed onto the second connecting end of a second end panel of the chain-like structure, wherein the male coupling member and the female coupling member are coupled to each other to lock the first end panel and the second end panel in an unfolding position of the plurality of hinges to form a frustum configuration;

a top surface of each panel of the plurality of panels, wherein top surfaces of the plurality of panels are configured to receive a seat member, in the folded position of the plurality of hinges; and a plurality of support beams, each support beam mounted on each hinge of the plurality of hinges for enclosing ends of the plurality of panels in the unfolded position.

2. The structure as claimed in claim 1, wherein at least one panel of the plurality of panels is configured with a writing board.

3. The structure as claimed in claim 1, wherein at least one panel of the plurality of panels is configured with a plurality of ribs extending along length of the at least one panel, for enabling a user to climb the at least one panel.

4. The structure as claimed in claim 1, wherein at least one panel of the plurality of panels is configured with a plurality of protrusions to enable a user to climb onto the at least one panel.

5. The structure as claimed in claim 1, wherein at least one panel of the plurality of panels is configured with a plurality of elongated slots to enable a user to climb onto the at least one panel.

6. The structure as claimed in claim 1 further comprising a bottom surface of each panel of the plurality of panels, wherein bottom surfaces of the plurality of panels are configured to act as a base for supporting the structure on a ground surface.

7. The structure as claimed in claim 1, wherein at least one panel of the plurality of panels is configured with at least one slot for allowing a user to enter and exit a hollow portion configured in the frustum configuration.

8. The structure as claimed in claim 1, wherein a panel of the plurality of panels comprises a coupling unit configured proximal to a top surface of the panel for receiving a slide member, the slide member including one end coupled to the coupling member and another end resting on a ground surface, wherein the slide member is inclined relative to the ground surface for enabling a user to slide therefrom, the slide member including protruded edges for confining sliding of the user along a length of the slide member.

9. The structure as claimed in claim 1, wherein a number of panels in the plurality of panels is four.

10. A collapsible activity structure, comprising:

a plurality of panels arranged in a chain-like structure through a plurality of hinges, each panel of the plurality of panels comprising a first connecting end and a second connecting end, each hinge of the plurality of hinges coupling the first connecting end of a panel to the second connecting end of an adjacent panel of the plurality of panels, wherein in a folded position of the plurality of hinges, the plurality of panels are in a stacked configuration;

a coupling member comprising a male coupling member and a female coupling member, the male coupling member disposed onto the first connecting end of a first end panel of the chain-like structure and the female coupling member configured onto the second connecting end of a second end panel of the chain structure, wherein the male coupling member and the female coupling member are coupled to each other to lock the first end panel and the second end panel in an unfolding position of the plurality of hinges to form a frustum configuration; a seat member mounted on a top surface of each panel of the plurality of panels in the unfolded position of the plurality of hinges; and a slide member comprising one end coupled to a coupling member configured proximal to a top surface of a panel and another end resting on a ground surface, the coupling unit configured on a top surface of the panel, wherein the slide member is inclined relative to a ground surface for enabling the child to slide therefrom.

11. The structure as claimed in claim 10, wherein at least one panel of the plurality of panels is configured with a writing board.

12. The structure as claimed in claim 10, wherein at least one panel of the plurality of panels are configured with a plurality of ribs extending along length of the at least one panel, for enabling a user to climb the at least one panel.

13. The structure as claimed in claim 10, wherein at least one panel of the plurality of panels is configured with a plurality of protrusions to enable a user to climb onto the at least one panel.

14. The structure as claimed in claim 10, wherein at least one panel of the plurality of panels is configured with a plurality of elongated slots to enable a user to climb onto the at least one panel.

15. The structure as claimed in claim 10 further comprising a bottom surface of each panel of the plurality of panels, the bottom surface of each of the panels are configured to act as a base for supporting the structure on a ground surface.

16. The structure as claimed in claim 10, wherein at least one panel of the plurality of panels is configured with at least one slot for allowing a user to enter and exit a hollow portion configured in the frustum configuration.

17. The structure as claimed in claim 10, further comprising a plurality of support beams, each support beam mounted on each hinge of the plurality of hinges for enclosing ends of the plurality of panels in the unfolded position.

18. A collapsible activity structure, comprising:

four panels arranged in a chain-like structure through a plurality of hinges, each panel comprising a first connecting end and a second connecting end, each hinge of the plurality of hinges coupling the first connecting end of a panel to the second connecting end of an adjacent panel of the four panels, wherein in a folded position of the plurality of hinges, four panels are in a stacked configuration;

a coupling member comprising a male coupling member and a female coupling member, the male coupling member disposed onto the first connecting end of a first panel of the chain-like structure and the female coupling member configured onto the second connecting end of a fourth panel of the chain-like structure, wherein the male coupling member and the female coupling member are coupled to each other to lock the first panel and the fourth panel in an unfolding position of the plurality of hinges to form a frustum configuration;

a top surface of each panel of the plurality of panels, wherein top surfaces of the plurality of panels are configured to receive a seat member, in the folded position of the plurality of hinges; and a plurality of support beams, each support beam mounted on each hinge of the plurality of hinges for enclosing ends of the plurality of panels in the unfolded position.

* * * * *